US006409884B2

(12) United States Patent
Brox

(10) Patent No.: US 6,409,884 B2
(45) Date of Patent: Jun. 25, 2002

(54) PRESS DEVICE HAVING AN EXTENDED NIP FOR PRESSING A RUNNING PAPER OR PAPERBOARD WEB

(75) Inventor: Erik Brox, Trollstigen 20 (SE)

(73) Assignee: Metso Paper Karlstad AB, Karlstad (SE)

( * ) Notice: Subject to any disclaimer, the term of this patent is extended or adjusted under 35 U.S.C. 154(b) by 0 days.

(21) Appl. No.: 09/779,781

(22) Filed: Feb. 8, 2001

Related U.S. Application Data

(60) Provisional application No. 60/184,360, filed on Feb. 23, 2000.

(30) Foreign Application Priority Data

Feb. 18, 2000 (SE) ..... 0000528-0

(51) Int. Cl.[7] ..... D21F 3/00

(52) U.S. Cl. ..... 162/358.3; 100/153; 162/361; 492/20

(58) Field of Search ..... 162/358.3–358.5, 162/361; 492/7, 20; 100/153, 162 B

(56) References Cited

U.S. PATENT DOCUMENTS 4,917,767 A * 4/1990 Ilmarinen et al. ..... 162/358.3
5,997,696 A * 12/1999 Gustavsson et al. ..... 162/358.3
6,017,422 A * 1/2000 Brox ..... 162/358.5
6,083,352 A * 7/2000 Snellman ..... 162/358.4

* cited by examiner

*Primary Examiner*—Karen M. Hastings
(74) *Attorney, Agent, or Firm*—Alston & Bird LLP

(57) ABSTRACT

A press device having an extended press nip for pressing a running paper or paperboard web, comprising a carrier supporting a press shoe via a plurality of loading cylinders, out of which at least a few comprise a first cylinder member having a first end attached to or integrated in the press shoe, and a second cylinder member having a second end attached to or integrated in the carrier. The first and the second cylinder members are slidably coupled to each other by a coupling member, wherein the coupling member and the first cylinder member are displaceable in relation to each other with a first length of stroke, while the coupling member and the second cylinder member are displaceable in relation to each other with a second length of stroke. The coupling member is designed so that the first length of stroke runs closer to the carrier than the second length of stroke.

9 Claims, 2 Drawing Sheets

PRESS DEVICE HAVING AN EXTENDED NIP FOR PRESSING A RUNNING PAPER OR PAPERBOARD WEB

CROSS-REFERENCE TO RELATED APPLICATION

The present application claims the benefit of the filing date of U.S. Provisional Patent Application No. 60/184,360, filed Feb. 23, 2000.

FIELD OF THE INVENTION

The present invention relates to a press device having an extended nip intended for pressing a running paper or paperboard web. More specifically, the invention relates to a shoe press having a support that supports a press shoe adjacent to a counter roll or another backing member in such a way that the press shoe and the backing member form an extended nip therebetween, and having a hydraulic or pneumatic arrangement for urging the press shoe toward the backing member in order to apply pressure on the web passing through the nip.

The press device according to the invention particularly advantageously can be utilized for wet-pressing of moist paper or paperboard webs, but also for calendering or other finishing of dried paper or paperboard. The press device according to the invention can also be utilized for fiber webs other than paper and paperboard.

BACKGROUND OF THE INVENTION

Shoe press devices having an extended nip have been employed for many years when manufacturing different paper and paperboard grades, primarily for wet-pressing in order to increase the dryness of the web, but also for calendering and other finishing in order to improve surface properties or other physical properties of the web.

As a result of their longer nips, shoe press devices provide a number of advantages in comparison to conventional roll presses, such as a higher dryness at the same nip pressure, or the ability to press at a lower at nip pressure while maintaining the same dryness, which is more gentle to the sheet. U.S. Pat. No. 4,917,768 discloses a shoe press device in which the press shoe is supported via tubular sleeves rigidly affixed to and spaced apart on a support in a direction across the machine direction. The sleeves are received in cylindrical recesses in the press shoe in order to allow the press shoe to move toward or away from a counter roll such that the nip pressure can be varied. The disclosed shoe press comprises hydraulic jacks upstream and downstream of the sleeves for forcing the press shoe against the counter roll and for pivoting the shoe about an axis that extends in the cross-machine direction in order to vary the nip pressure in the machine direction. The sleeves fit somewhat loosely in the recesses in the shoe, and a resilient seal encircles each sleeve for sealing the interface between the sleeve and the recess. Accordingly, the press shoe of the shoe press disclosed in U.S. Pat. No. 4,917,768 is capable of pivoting relative to the support for varying the nip pressure in the machine direction.

However, it has been found that such shoe presses can be associated with certain problems. One such problem originates from the thermal expansion of the press shoe, which is a result of the heat generated by friction against the belt that runs over the press shoe and carries the paper or paperboard web through the press and by the hot hydraulic fluid that for different reasons is circulated through the shoe. The thermal expansion of the press shoe results in an elongation of the shoe in the cross-machine direction, which creates bending tensions in the support and hydraulic arrangement of the press shoe, which of course is undesirable.

In EP 0 933 471, corresponding to U.S. Pat. No. 6,083,352, the disclosure of which is incorporated herein by reference, a shoe press is disclosed that reduces the problems originating from the thermal expansion of the press shoe, since it has the ability to tolerate relatively large elongations of the press shoe across the machine direction, and also other deformations of the press shoe. The disclosed shoe press comprises a press shoe extending in the cross-machine direction along the entire width of a web running through the press, and a plurality of articulated hydraulic loading cylinders supported by a support and spaced apart along the shoe. The loading cylinders define working chambers that are pressurizable by hydraulic fluid, so as to enable the cylinders to urge the press shoe away from the support and toward a counter roll or other backing member for applying pressure to the web being carried through the nip defined between the shoe and the backing member. Each loading cylinder comprises a piston member disposed within a cylinder member. Either the piston or the cylinder comprises a two-part member having a first member fixed relative the press shoe and a second member fixed relative to the support, while the remaining piston or cylinder comprises a coupler.

In a preferred embodiment of the shoe press according to EP 0 933 471, the two-part member consists of first and second cylinders, while the coupler comprises a piston that is slidably received in the two cylinders. In an alternative preferred embodiment the two-part member instead comprises first and second pistons, while the coupler comprises a cylinder that surrounds both pistons.

The coupler of the shoe press disclosed in EP 0 933 471 sealingly engages at least one of the members, so that the first member is urged away from the second member in a loading direction when pressurizing the working chamber to cause the press shoe to be urged towards the backing member. In order to enable the loading cylinders to accommodate elongation of the press shoe across the machine direction, each coupler engages the respective first and second members at seals that enable the coupler to pivot relative to the first and second members about axes parallel to the machine direction. Accordingly, the press shoe is free to expand thermally in the cross-machine direction without causing bending of any piston and/or cylinder members of the loading cylinders.

Since the press shoe of the shoe press disclosed in EP 0 933 471 also can move or be tilted in the machine direction in relation to the carrier, the shoe press comprises a stopping member that restricts the movement of the shoe forwards in the machine direction.

Accordingly, the loading cylinders of the above-described types of shoe press devices have piston and cylinder members that can be tilted in relation to each other and/or in relation to the press shoe in order to accommodate movements of the press shoe in relation to the carrier across the machine direction, and also in the machine direction. Even if such tilting is necessary, in reality it is undesired since it can result in elastic seals of the loading cylinders being subjected to large stresses, or in very large forces being directed against the guiding or stopping means that in accordance with the present techniques are necessary for ensuring that the press force exercised by the press shoe is directed in the intended direction towards the counter member when lengthening the loading cylinders. Therefore, it would be advantageous to provide a press device having loading cylinders that allow skewness between the relatively slidable cylinder members included in the loading cylinder when necessary, but that otherwise counteract such skewness.

SUMMARY OF THE INVENTION

Accordingly, the present invention seeks to provide a press device having an extended nip for pressing a running paper or paperboard web, in which device the loading cylinders when necessary allow but otherwise counteract skewness between the relatively slidable cylinder members, and which ensures that the lengthening force of the loading cylinders in all circumstances are directed in the intended direction, in order to thereby minimize the stresses acting on the elastic seals of the loading cylinders and the forces that during the pressing may come to be directed towards guiding or stopping means for the press shoe of the press device.

In accordance with the invention, a press device comprises a press shoe extending across the machine direction and arranged for forming an extended nip in cooperation with a counter member for passage of the web during the pressing. The press device further comprises a carrier supporting the press shoe such that the press shoe is displaceable toward and away from the counter member by a plurality of loading cylinders spaced apart along the press shoe for enabling application of pressure onto the web during the pressing. At least a few of the loading cylinders comprise a first cylinder member having a first end attached to or integrated in the press shoe, and a second cylinder member having a second end attached to or integrated in the carrier. The first and the second cylinder member are slidably coupled to each other by a generally tubular coupling member. The coupling member has a first portion that slidably engages the first cylinder member and is displaceable over a first length of stroke L1 relative to the first cylinder member, and a second portion that slidably engages the second cylinder member and is displaceable over a second length of stroke L2 relative to the second cylinder member. The first portion of the coupling member is closer to the carrier than is the second portion of the coupling member.

In another aspect of the invention, a first seal is disposed between the coupling member and the first cylinder member for sealing the connection therebetween, and a second seal is disposed between the coupling member and the second cylinder member for sealing the connection therebetween, such that a sealed working chamber is formed in the loading cylinder. Lateral displacement of the press shoe relative to the carrier exerts a moment on the coupling member causing the coupling member to pivot about a central axis of the second cylinder member, and the cylinder members and coupling member are arranged such that said pivoting of the coupling member exposes surfaces of the coupling member to fluid pressure in the working chamber and said surfaces are located such that the fluid pressure acting on said surfaces generates a moment on the coupling member in a direction opposite to that exerted by the displacement of the press shoe. Accordingly, the coupling member tends to be restored toward its original undisplaced position.

BRIEF DESCRIPTION OF THE DRAWINGS

In the following, the invention will be described in greater detail with reference to the attached drawings, in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
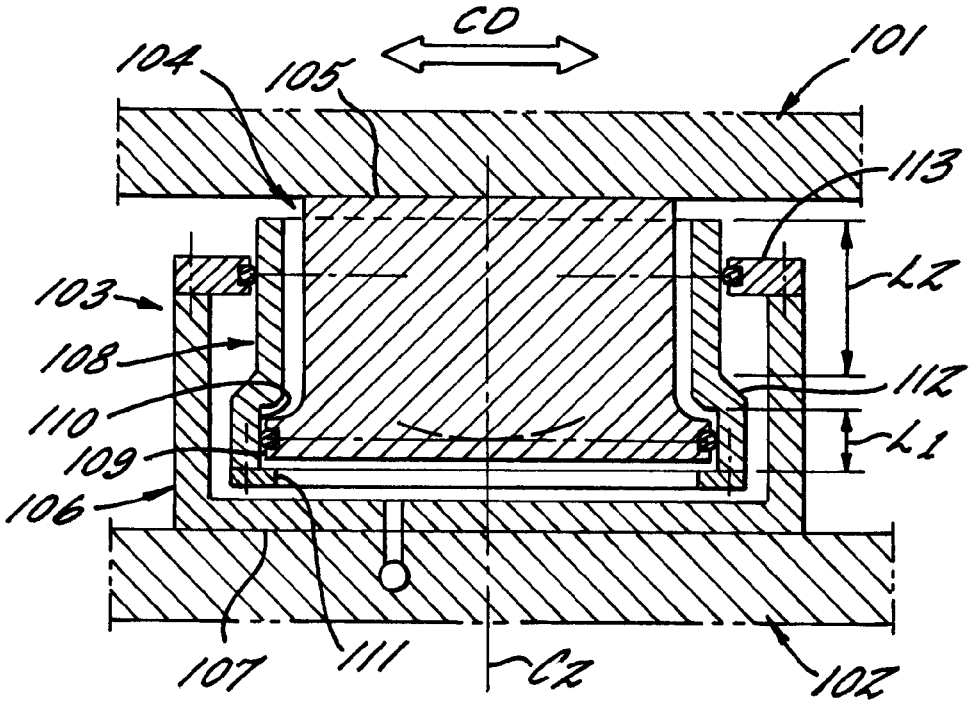
FIG. 1A shows a schematic sectional view, seen in the machine direction, of a loading cylinder of a press device having an extended nip according to a preferred embodiment of the invention, without any skewness between the cylinder members.
Figure 1B:
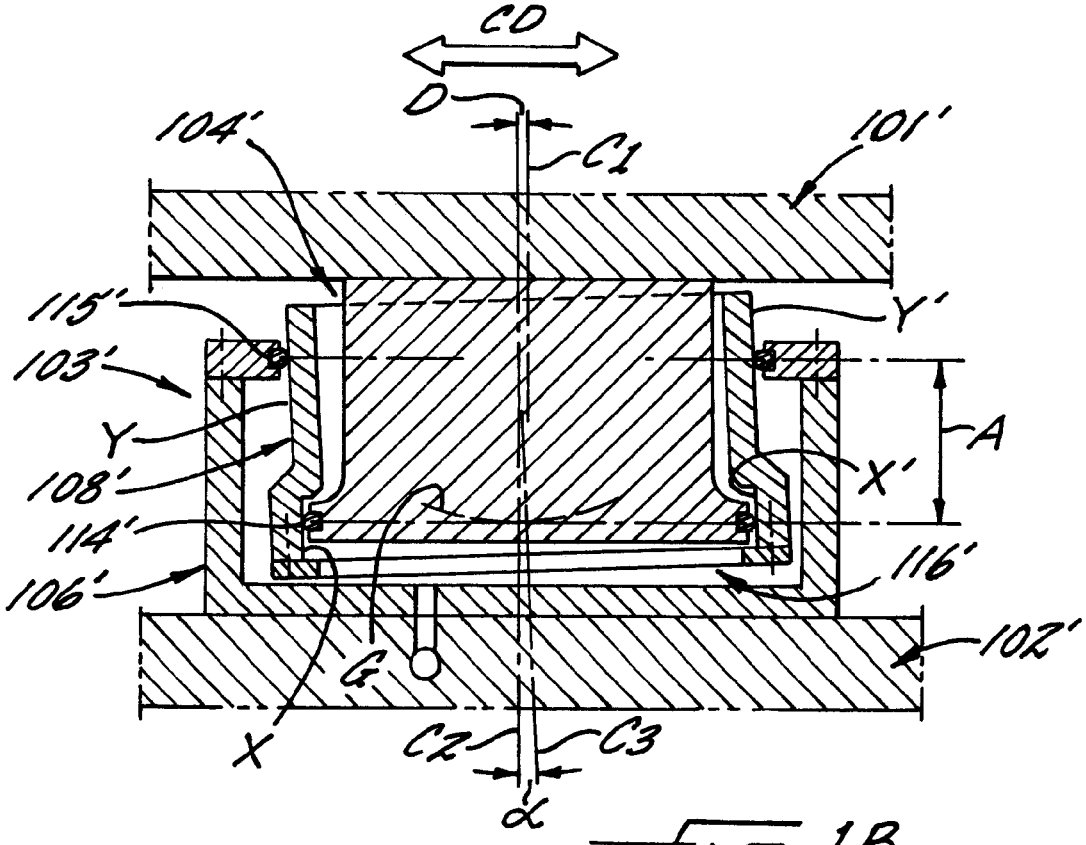
FIG. 1B shows the loading cylinder in FIG. 1A, but when the press shoe has been displaced or has moved in relation to the carrier so that the cylinder members have been tilted in relation to each other.

The attached FIGS. 1A and 1B show two different schematic sectional views seen in the machine direction, i.e. across the cross-direction CD indicated in the Figures, of a loading cylinder of a press device having an extended nip according to a preferred embodiment of the invention without, and with, skewness between the cylinder members.

Figure 2A:
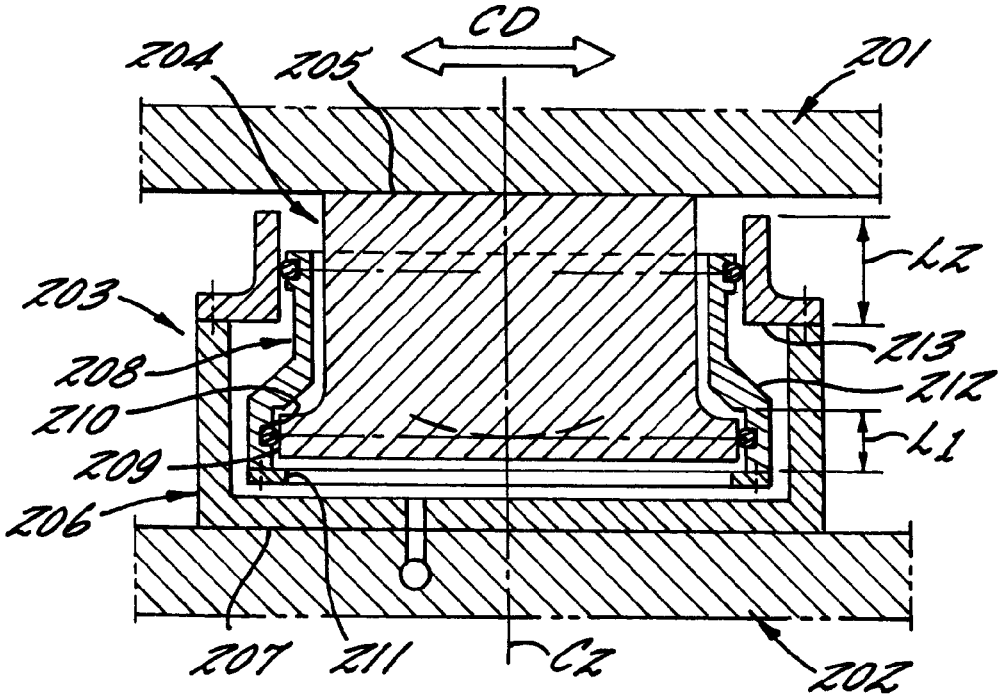
FIG. 2A shows a schematic sectional view, seen in the machine direction, of loading cylinder of a press device having an extended nip according to another advantageous embodiment of the invention, without any skewness between the cylinder members.
Figure 2B:
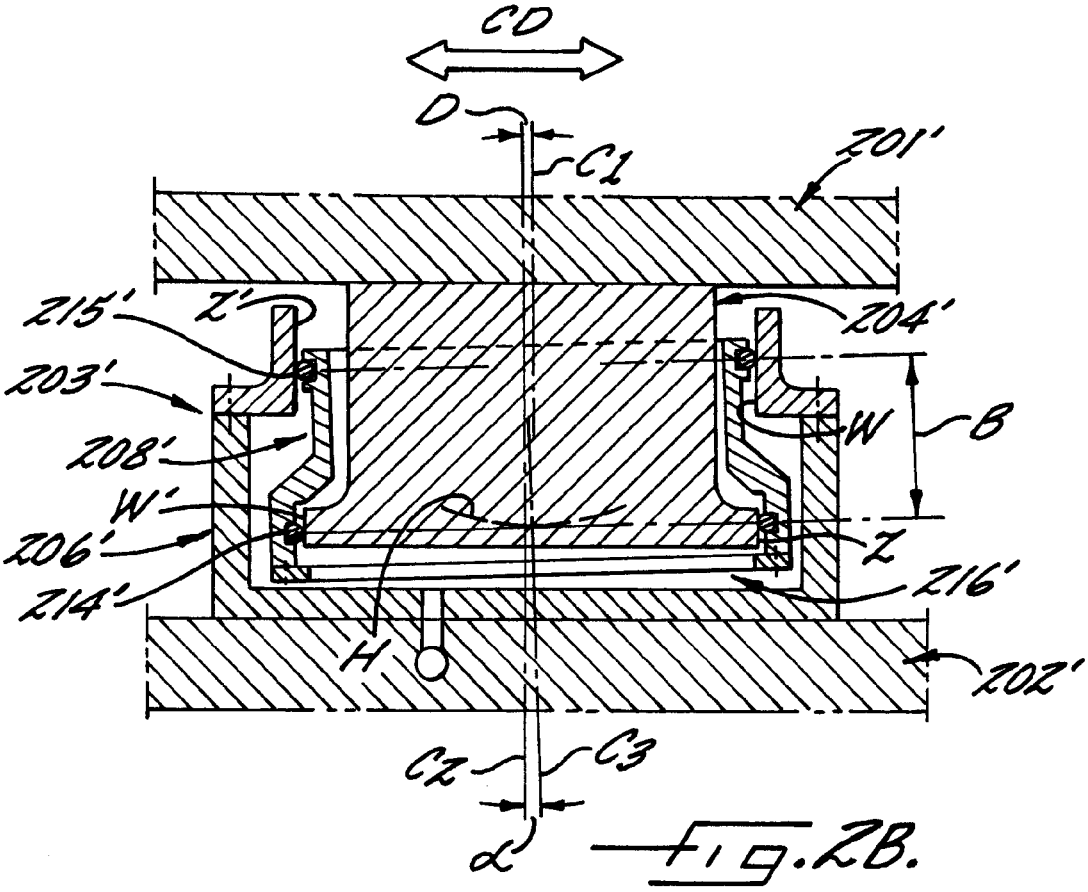
FIG. 2B shows the loading cylinder in FIG. 2A but when the press shoe has been displaced or has moved in relation to the carrier so that the cylinder members have been tilted in relation to each other.

FIGS. 2A and 2B show corresponding views as in FIGS. 1A and 1B, but of a press device having an extended nip according to another advantageous embodiment of the invention.

Accordingly, FIGS. 1A–2B show two different designs of loading cylinders included in the press device according to the invention, which is intended for pressing a running paper or paperboard web. The remaining components of the press device according to the invention can be of types that are previously known per se, for example those that are disclosed in the above-mentioned EP 0 933 471.

Now referring to FIGS. 1A and 2A, the press device according to the invention comprises a press shoe 101; 201, aligned across the machine direction, of which only a minor portion is visible in the drawings. The press shoe is arranged for forming an extended nip (not shown), in cooperation with a counter member (not shown in the drawings), for passage of the web (not shown) during the pressing.

The press device according to the invention further comprises a carrier 102; 202 supporting the press shoe 101; 201 such that the press shoe is displaceable toward and away from the counter member via a plurality of loading cylinders 103; 203 spaced apart along the press shoe 101; 201 for enabling application of pressure onto the web during the pressing. At least a few of the loading cylinders 103; 203 comprise a first cylinder member 104; 204 having a first end 105; 205 attached to or integrated in the press shoe 101; 201, and a second cylinder member 106; 206 having a second end 107; 207 attached to or integrated in the carrier 102; 202. The first 104; 204 and second 106; 206 cylinder members are slidably coupled to each other by a generally tubular coupling member 108; 208, wherein the coupling member 108; 208 and the first cylinder member 104; 204 are displaceable in relation to each other with a first length of stroke L1, while the coupling member 108; 208 and the second cylinder member 106; 206 are displaceable in relation to each other with a second length of stroke L2.

Thereby, according to the invention and the preferred embodiment, the coupling member 108; 208 is designed so that the first length of stroke L1 runs closer to the carrier 102; 202 than the second length of stroke L2. As a consequence, the loading cylinders in accordance with the invention have "self-centering properties", i.e., when the cylinder members 104, 106; 204, 206, which are slidable in relation to each other, are tilted in relation to each other they will strive to return to their natural "position of rest" where no skewness occurs. The function of a loading cylinder included in the arrangement according to the invention can be compared to the function of a cardan joint axle suspended vertically from its upper end. In case the lower end of the cardan axle is displaced laterally, it will strive back towards the vertical position, in a way that on the whole can be compared to the self-centering properties of the loading cylinders included in the arrangement according to the invention.

In one advantageous embodiment, one or several stopping means 109, 110, 111; 209, 210, 211 are arranged on the first cylinder member 104; 204 and/or on the coupling member 108; 208 in order to restrict the first length of stroke L1. In another embodiment, one or several stopping means 112, 113; 212, 213 are arranged on the coupling member 108; 208 and/or on the second cylinder member 106; 206 in order to restrict the second length of stroke L2.

In the following, referring to FIGS. 1B and 2B, the "self-centering" properties of a loading cylinder included in a press device according to an advantageous embodiment of the invention will be explained in greater detail.

The self-centering properties exhibited by the loading cylinder 103'; 203' of the press device according to the invention can be explained in the following way. In case the coupling member 108'; 208' is tilted, surfaces X, X', Y, Y', Z, Z', W, W' will be covered/exposed, which will influence the equilibrium of forces. Starting from FIG. 1B, it can be established that when the first cylinder member 104' is displaced to the right in the Figure (with a displacement of its central axis $C_1$ a distance D), a moment is exerted on the coupling member 108' in a counter clockwise direction and hence the coupling member 108' will pivot in the counter clockwise direction (illustrated by the angle $\alpha$ between the central axes $C_2$ and $C_3$ of the second cylinder member 106 and coupling member 108', respectively). Accordingly, fluid pressure on the surface X exposed within the working chamber 116' will generate a force on the coupling member 108' directed to the left in the Figure so as to produce a clockwise moment on the coupling member 108' tending to restore the coupling member to its original undisplaced position. The coupling member in turn will tend to urge the first cylinder member 104' back toward its original undisplaced position.

To sum up, a relative displacement between the first 104' and second cylinder members 106 of the loading cylinder 103' according to the invention cannot be achieved without performing a work.

Accordingly, in one advantageous embodiment of the invention, particularly illustrated by FIGS. 1B and 2B, the coupling member 108'; 208' slidably couples the first cylinder member 104'; 204' and the second cylinder member 106; 206 to each other in a sealed way by means of contacting seals 114', 115'; 214', 215' in order to form at least one working chamber 116'; 216' within which the pressure of a pressurizing medium can be reduced in order to generate a shortening or increased in order to generate a lengthening of the loading cylinder 103'; 203'. In this embodiment, at least one first seal 114; 214' bears against the first cylinder member 104'; 204' and the coupling member 108'; 208' while at least one second seal 115'; 215' bears against the coupling member 108'; 208' and the second cylinder member 106; 206. The cylinder members 104'; 106; 204', 206, the coupling member 108'; 208' and the seals 114', 115'; 214', 215' are arranged in such a way that, in case of a displacement of the press shoe, the first cylinder member 104'; 204' is displaced in a direction in relation to the second cylinder member 106; 206, while a central axis $C_3$ of the coupling member 108'; 208' is tilted in relation to a central axis $C_2$ of the second cylinder member 106; 206, wherein the pressure acting on surfaces X; Z exposed within the working chamber 116'; 216' generates a moment on the coupling member 108'; 208' in a direction opposite to the tilting of the coupling member, which in turn urges the first cylinder member back towards its undisplaced position.

In still another advantageous embodiment, particularly illustrated by FIG. 1B, the first seal 114' is constituted of a seal ring inserted into a groove extending along an outer circumference of the first cylinder member 104', while the second seal 115' is constituted of a seal ring inserted into a groove extending along an inner "circumference" of the second cylinder member 106.

In another advantageous embodiment, particularly illustrated by FIG. 2B, the first seal 214' comprises a seal ring retained in a groove extending along an inner circumference of the coupling member 208', while the second seal 215' comprises a seal ring retained in a groove extending along an outer circumference of the coupling member 208'.

The above-mentioned counter member (not shown in the drawings) of the press device according to the invention is particularly advantageously a rotatable counter roll, wherein a flexible belt (not shown), preferably in the form of a sleeve, is arranged in an endless loop for travelling between the press shoe 101, 101'; 201, 201' and the paper or paperboard web (not shown) during the pressing.

The press device according to the invention is preferably intended for wet pressing or for calendering of a paper or paperboard web.

The present invention should by no means be regarded as being limited to what has been disclosed herein in connection with the different embodiments, or to what is shown in the accompanying drawings, but the scope of the invention is defined by the following claims.

As has become evident from the foregoing, mechanical and hydraulic, or optionally pneumatic, components included in the shoe press device according to the invention have not been described in any greater detail herein, since such components should be well known to the skilled person and also are described and illustrated in the above-mentioned EP 0 933 471.

Within the scope of the invention, it is conceivable that either the first or the second cylinder member can be a substantially solid piston while the coupling member has the shape of a sleeve. Alternatively, the first and second cylinder members and the coupling member all can have the shape of a sleeve. It should also be apparent that the loading cylinders shown in the Figures can be used in an inverted orientation such that reference numeral 102 can be regarded as the press shoe and reference numeral 101 can be regarded as the carrier, and the functioning of the loading cylinder will be identical to what has been described above. In this case, reference numeral 106 would comprise the first cylinder member and reference numeral 104 would comprise the second cylinder member within the meaning of the foregoing description and the following claims.

Furthermore, it should be noted that the paper or paperboard web during the pressing preferably is carried through the press nip of the press device according to the invention by one or several pieces of water-receiving machine clothing, such as one or several press felts (not shown).

What is claimed is:

1. A press device for pressing a traveling fibrous web, comprising:

a press shoe extending in a cross-machine direction;

a counter member arranged so as to form an extended nip with the press shoe for passage of the web therethrough;

a carrier supporting the press shoe such that the press shoe is movable toward and away from the counter member;

a plurality of loading cylinders arranged between the carrier and the press shoe and spaced apart along the press shoe, the loading cylinders being operable by application of fluid pressure to urge the press shoe toward the counter member to press the web in the nip, wherein at least some of the loading cylinders comprise a first cylinder member fixed on the press shoe and extending toward the carrier, a second cylinder member fixed on the carrier and extending toward the press shoe, and a generally tubular coupling member that slidably couples the first cylinder member with the second cylinder member, the coupling member having a first portion that slidably engages the first cylinder member and is displaceable over a first length of stroke L1 relative to the first cylinder member, the coupling member having a second portion that slidably engages the second cylinder member and is displaceable over a second length of stroke L2 relative to the second cylinder member, and wherein the first portion of the coupling member is closer to the carrier than is the second portion of the coupling member.

2. The press device of claim 1, wherein the coupling member receives the first cylinder member inside the coupling member, and the second cylinder member is generally tubular and receives the coupling member inside the second cylinder member.

3. The press device of claim 1, further comprising at least one stopping member arranged on at least one of the first cylinder member and the coupling member for limiting the first length of stroke L1.

4. The press device of claim 1, further comprising at least one stopping member arranged on at least one of the second cylinder member and the coupling member for limiting the second length of stroke L2.

5. The press device of claim 1, further comprising a first seal disposed between the first portion of the coupling member and the first cylinder member and a second seal disposed between the second portion of the coupling member and the second cylinder member such that a sealed working chamber is defined in the loading cylinder, increase of fluid pressure within the working chamber causing a lengthening of the loading cylinder.

6. A press device for pressing a traveling fibrous web, comprising:

a press shoe extending in a cross-machine direction;

a counter member arranged so as to form an extended nip with the press shoe for passage of the web therethrough;

a carrier supporting the press shoe such that the press shoe is movable toward and away from the counter member;

a plurality of loading cylinders arranged between the carrier and the press shoe and spaced apart along the press shoe, the loading cylinders being operable by application of fluid pressure to urge the press shoe toward the counter member to press the web in the nip, wherein at least some of the loading cylinders comprise a first cylinder member fixed on the press shoe and extending toward the carrier, a second cylinder member fixed on the carrier and extending toward the press shoe, and a generally tubular coupling member forming slidable connections with the first cylinder member and with the second cylinder member, a first seal being disposed between the coupling member and the first cylinder member for sealing the connection therebetween, and a second seal being disposed between the coupling member and the second cylinder member for sealing the connection therebetween, such that a sealed working chamber is formed in the loading cylinder, lateral displacement of the press shoe relative to the carrier exerting a moment on the coupling member causing the coupling member to pivot about a central axis of the second cylinder member, and wherein the first seal is disposed closer to the carrier than is the second seal such that said pivoting of the coupling member exposes surfaces in the working chamber to fluid pressure and said surfaces are located such that the fluid pressure acting on said surfaces generates a force in a direction opposite to the relative displacement of the press shoe.

7. The press device of claim 6, wherein the first seal comprises a seal ring disposed in a groove formed about an outer circumference of the first cylinder member and the second seal comprises a seal ring disposed in a groove formed about an inner circumference of the second cylinder member.

8. The press device of claim 6, wherein the first seal comprises a seal ring disposed in a groove formed about an inner circumference of the coupling member and the second seal comprises a seal ring disposed in a groove formed about an outer circumference of the coupling member.

9. The press device of claim 6, wherein the coupling member receives the first cylinder member inside the coupling member, and the second cylinder member is generally tubular and receives the coupling member inside the second cylinder member.

* * * * *